United States Patent [19]

Aubert

[11] Patent Number: 4,615,272

[45] Date of Patent: Oct. 7, 1986

[54] BOMB AND BOMB LINER

[75] Inventor: Stephen A. Aubert, Eglin AFB, Fla.

[73] Assignee: The United States of America as represented by the Secretary of the Air Force, Washington, D.C.

[21] Appl. No.: 649,565

[22] Filed: Sep. 12, 1984

[51] Int. Cl.[4] ..... F42B 5/30

[52] U.S. Cl. ..... 102/466; 102/479; 102/481; 102/331

[58] Field of Search ..... 102/290, 430, 465, 466, 102/473, 479, 481, 331

[56] References Cited

U.S. PATENT DOCUMENTS

| | | | |
|---|---|---|---|
| 3,120,070 | 2/1964 | Coover et al. | 260/45.5 |
| 3,271,340 | 9/1966 | Shearer, Jr. et al. | 260/28.5 |
| 3,900,534 | 8/1975 | Schard | 260/897 A |
| 3,943,208 | 3/1976 | Ratte et al. | 149/19.92 X |
| 3,948,177 | 4/1976 | Fitch | 102/318 |
| 3,954,701 | 5/1976 | Schaffling | 102/290 X |
| 4,206,006 | 6/1980 | Ratz | 149/19.9 |
| 4,328,753 | 5/1982 | Kristensen et al. | 102/275.5 |
| 4,337,218 | 6/1982 | Byrd et al. | 102/289 X |
| 4,377,678 | 3/1983 | Fukuma et al. | 149/19.4 X |

*Primary Examiner*—Peter A. Nelson

*Attorney, Agent, or Firm*—Charles E. Bricker; Donald J. Singer

[57] ABSTRACT

A general purpose aerial bomb and a thermoplastic liner therefor consisting essentially of a melt blend of polypropylene and polybutene.

8 Claims, 1 Drawing Figure

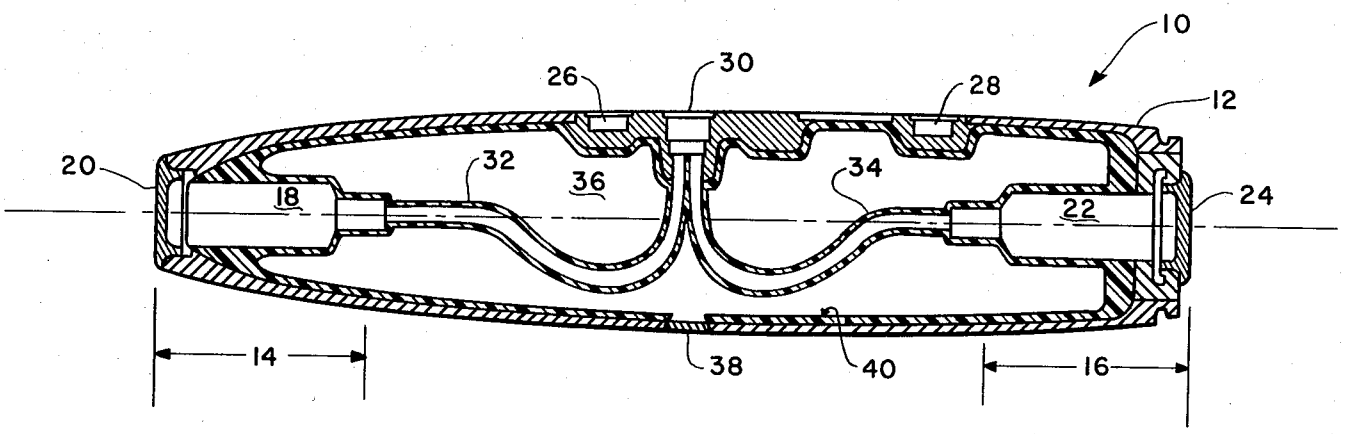
10
12
24
22
16
28
34
40
30
38
26
36
32
18
14
20

BOMB AND BOMB LINER

RIGHTS OF THE GOVERNMENT

The invention described herein may be manufactured and used by or for the Government of the United States for all governmental purposes without the payment of any royalty.

BACKGROUND OF THE INVENTION

This invention relates broadly to thermoplastic formulations, particularly formulations having a low glass transition point. In one aspect this invention relates to a liner for high explosive devices. In another aspect, this invention relates to thermoplastic formulations.

General Purpose (GP) aerial bombs are lined with a thermoplastic material prior to filling with an explosive in order to provide a barrier between the explosive and the bomb case. The practice of lining GP bombs began in the late 1950's in order to provide an impact cushion for the weapons, particularly in areas of possible pinch points such as the nose and tail fusewells and flange assembly threads. As ammonium nitrate (AN) based explosives came into general use, the liner assumed importance as a mechanical barrier to prevent chemical interaction between the explosive and the case.

The range of qualities required or desired of a bomb liner includes the following:

a. chemical compatibility with the explosive and with the bomb case, in order to prevent decomposition of the explosive, gas generation and or sensitization during storage;

b. low or nil permeability to moisture in order to prevent ingress of moisture which could accelerate decomposition of the explosive, particularly AN based explosives;

c. good adhesion to the bomb case;

d. resilience when subjected to rapid temperature cycling in order to maintain liner integrity;

e. dimensional stability against cold flow during storage;

f. resilience when subjected to impact such as when the bomb is dropped a few feet;

g. ease of installation of the liner together with the ability to withstand the heat of a melt cast explosive at about 220° F.; and h. relatively low cost.

Roof asphalt was initially adopted as the primary bomb liner because of its low cost, ease of application and availability. The asphalt is molten at 400° F. and can be applied by a simple pour in/pour out technique. It can withstand the heat of a melt cast explosive at about 220° F. It has excellent low temperature resilience, having an operational temperature range of −65° F. to +160° F., with an expected operational lifetime of 20 years.

Asphalt is not a pure, homogeneous product. Depending upon its source, asphalt can contain up to 6% or more of sulfur and up to 25% or more of mineral matter. The sulfur and mineral matter in asphalt are generally incompatible with explosives. Compatibility problems have been noted in asphalt-lined bombs containing ammonium nitrate-based explosives, in particular, as well as in bombs containing other explosives.

It has been proposed to replace the asphalt bomb liner with amorphpous polypropylene. Although it is chemically compatible with the high explosives, it is not fully satisfactory as a replacement liner, primarily because of its physical behavior.

Accordingly, it is an object of the present invention to provide a novel thermoplastic formulation which satisfies the requirements for a bomb liner.

Another object of the present invention is to provide a general purpose aerial bomb having an improved thermoplastic liner.

Other objects, aspects and advantages of the present invention will be apparent to those skilled in the art from the following description of the invention.

SUMMARY OF THE INVENTION

In accordance with the present invention there is provided a polymer blend suitable for use as a bomb liner which consists essentially of about 80 to 60 weight percent of amorphous polypropylene and about 20 to 40 weight percent of polybutene.

Also provided in accordance with the present invention is a general purpose aerial bomb having an improved thermoplastic liner consisting of the above-described polymer blend.

BRIEF DESCRIPTION OF THE DRAWING

The FIGURE is a longitudinal cross-section of a general purpose aerial bomb having a thermoplastic liner.

DESCRIPTION OF THE INVENTION

Referring to the drawing, a general purpose aerial bomb is indicated generally at 10. The bomb 10 comprises a case 12 having a nose end portion 14 and a tail end portion 16. The nose end portion 14 comprises a fusewell 18 having an associated access plate 20. The tail end portion 16 comprises an aft fusewell 22 having an associated access plate 24. The case 12 has at least two attachment points 26 and 28 for attaching the bomb 10 to an aircraft bomb attaching and releasing assembly, not shown and not forming a part of this invention. Also shown is a charging port 30 for connection with means in the said assembly for arming the fuses (not shown) which are housed in the fusewells 18 and 22. Operative connections between the charging port 30 and the fuses in the fusewells 18 and 22 are made through charging tubes 32 and 34. The remainder of the cavity of case 12, indicated by the reference numeral 36 is filled with high explosive.

The case 12 also comprises a filling port, as indicated, for example, at 38 for filling the cavity 36 with an explosive. As discussed previously, the general purpose type aerial bomb has a liner. This liner is indicated generally at 40, interposed between the explosive material and the case 12, including the fusewells 18 and 22, charging tubes 32 and 34 and the like.

The liner 40 is introduced into the case 12 by a hot melt pour in/pour out method. A desired quantity of liner material is heated to the fluid state (about 400° F.), then poured into the case 12 through the port 38. The case, with the liner material inside is rotated about all its axes to completely coat the interior of case 12, including all interior accessory devices. Any excess liner material is poured out of the case. At some later time, the high explosive is melt cast into the bomb case.

The liner material of the present invention is a polymer blend consisting essentially of about 80 to 60 weight percent of amorphous polypropylene and about 20 to 40 weight percent of polybutene. The polypropylene which is the basic component of the liner material of this invention is formed during the stereospecific polymerization of propylene and is referred to as an "atactic" polymer in that repeating units of its polymeric chain vary in a random configuration along the chain. This is to be contrasted with the "isotactic" or "stereospecific" polymers wherein the repeating units of the polymeric chain all possess the same stereochemical configuration along the chain. Suitable amorphous polypropylene for use in the invention include Polyflow 250, available from Moore & Munger Marketing, Inc., Fairfield, CT and Eastabond G92, available from Eastman Chemical Products, Inc., Kingsport, TN.

The polybutene is a polymer which is liquid at room temperature. A suitable polybutene is Indopole H-1500, available from Amoco Chemicals Corporation, Chicago, IL.

The polypropylene and polybutene components comprising the liner material of the present invention are blended together to form a substantially homogeneous resin mixture. This may be accomplished, for example, by masticating the components on a differential speed, two-roll mill or in similar polymer blending machinery, such as a Baubury mill or an extruder having a suitable mixing flite at an elevated temperature not greater than about 200° C.

The resulting polymer blend may be used over a wide range of temperatures so as to retain flexibility down to temperatures as low as −65° F., yet does not appreciably soften or separate into its component parts when subjected to temperatures as high as 240° F.

Various modifications and variations may be made without departing from the spirit and scope of this invention.

I claim:

1. A polymeric bomb liner consisting essentially of about 80 to 60 weight percent of amorphous polypropylene and about 20 to 40 weight percent of polybutene.

2. The bomb liner of claim 1 wherein said polybutene is a liquid at room temperature.

3. The bomb liner of claim 1 wherein the amount of said propylene is about 75 weight percent and the amount of said polybutene is about 25 weight percent.

4. The bomb liner of claim 1 wherein the amount of said polypropylene is about 65 weight percent and the amount of said polybutene is about 35 weight percent.

5. A general purpose aerial bomb having a thermoplastic liner consisting essentially of a melt blend of amorphous polypropylene and polybutene.

6. The bomb of claim 5 wherein the said liner consists essentially of 80 to 60 weight percent amorphous polypropylene and about 20 to 40 weight percent polybutene.

7. The bomb of claim 5 wherein said liner consists essentially of about 75 weight percent of said polypropylene and about 25 weight percent of said polybutene.

8. The bomb of claim 5 wherein said liner consists essentially of about 65 weight percent of said polypropylene and about 35 weight percent of said polybutene.

* * * * *